US005794285A

United States Patent [19]

Burch

[11] Patent Number: 5,794,285

[45] Date of Patent: Aug. 18, 1998

[54] BED COVER ASSEMBLY

[76] Inventor: Reda R. Burch, 8609 Knollwood Cir., Charlotte, N.C. 28213

[21] Appl. No.: 792,182

[22] Filed: Jan. 30, 1997

[51] Int. Cl.[6] ..... A47G 9/04

[52] U.S. Cl. ..... 5/497; 5/494; 5/496; 5/500

[58] Field of Search ..... 5/485, 486, 494, 5/496, 497, 498, 499, 500, 502

[56] References Cited

U.S. PATENT DOCUMENTS

| | | | |
|---|---|---|---|
| 3,530,487 | 9/1970 | Beer | 5/494 |
| 3,962,739 | 6/1976 | Crockett | 5/497 |
| 4,301,561 | 11/1981 | McLeod | 5/498 |
| 4,411,034 | 10/1983 | Williams | 5/494 |
| 4,488,323 | 12/1984 | Colburn | 5/496 |
| 4,658,454 | 4/1987 | Potter | 5/500 |
| 5,027,456 | 7/1991 | Wadsworth | 5/494 |
| 5,084,929 | 2/1992 | Staudinger | 5/494 |

OTHER PUBLICATIONS

"Self-Adhering Nylon Tapes", Journal of A.M.A., vol. 168, No. 7, Maurice Gershman, M.D., Oct. 1958.

*Primary Examiner*—Brian K. Green
*Assistant Examiner*—Robert G. Santos
*Attorney, Agent, or Firm*—Adams Law Firm, P.A.

[57] ABSTRACT

A bed cover assembly for a mattress is provided. The assembly includes a bottom sheet adapted for covering a top surface and sides of the mattress. A top sheet overlies the bottom sheet. Elastic attachment sections are provided along a perimeter portion of the top sheet for elastically interconnecting the top sheet and the bottom sheet together. The elastic sections cooperate with the top sheet and bottom sheet to form a resilient sleeping pocket around a bed occupant positioned therebetween. The elastic sections accommodate movement of the top sheet relative to the bottom sheet upon movement of the bed occupant while maintaining the top sheet in an assembled condition over the bottom sheet and mattress.

14 Claims, 3 Drawing Sheets

BED COVER ASSEMBLY

TECHNICAL FIELD AND BACKGROUND OF THE INVENTION

This invention relates to a bed cover assembly for covering a mattress. The invention is adapted for covering a standard mattress or water bed mattress, and remains in a substantially assembled condition over the mattress during use by a bed occupant. The invention keeps the bed occupant covered when sleeping, and eliminates the time and effort required to reassemble the sheets on the mattress after use. The invention is particularly useful to infants, the elderly, and others with limited physical capabilities.

According to one prior art bed cover described in U.S. Pat. No. 5,084,929 ('929 Patent), the bottom fitted sheet and top flat sheet are sewn together along the foot end and portions of the sides of the flat sheet to form a sleeping enclosure around the bed occupant. In order to accommodate movement of the occupant, the flat sheet has pleats formed near the foot end in an area of the occupant's feet. A bottom elastic strap is connected to opposing side edges of the fitted sheet near the head of the sheet, and extends laterally across the bottom side of the mattress to keep the fitted sheet secure around the mattress during use.

While the '929 Patent addresses the desire to maintain the sheets in a substantially assembled condition over the bed occupant, it nevertheless suffers from drawbacks and limitations. Because the flat sheet is not elastically attached to the fitted sheet, the sheets do not form a resilient sleeping pocket around the bed occupant and do not provide substantial freedom to turn about during sleep. Moreover, the prior art bed cover requires an elastic strap attached to opposing sides of the fitted sheet and extending laterally across the underside of the mattress to secure the fitted sheet around the mattress. This increases the difficulty in changing the fitted sheet for washing. Furthermore, the '929 Patent describes only a single strap attached near the head end of the mattress. There is no feature provided for securing the foot end of the fitted sheet to the mattress.

SUMMARY OF THE INVENTION

Therefore, it is an object of the invention to provide a bed cover assembly which is adapted for use with a standard mattress or water bed mattress.

It is another object of the invention to provide a bed cover assembly which is particularly useful to infants, the elderly, and others with limited physical capabilities.

It is another object of the invention to provide a bed cover assembly which keeps the bed occupant covered when sleeping.

It is another object of the invention to provide a bed cover assembly which is formed such that the fitted sheet resists being pulled away from the mattress during use over the entire length of the mattress.

It is another object of the invention to provide a bed cover assembly which forms a resilient sleeping pocket around the bed occupant while allowing the occupant substantial freedom to turn about when sleeping.

It is another object of the invention to provide a bed cover assembly which remains in a secured position over the mattress during use, yet is readily removed from the mattress for washing.

It is another object of the invention to provide a bed cover assembly which is readily applied to the mattress.

It is another object of the invention to provide a bed cover assembly which includes a removable, elastically attached top comforter for covering the attached fitted and flat sheets and mattress.

It is another object of the invention to provide a bed cover assembly which includes a removable, elastically attached top spread for covering the attached fitted and flat sheets and mattress.

These and other objects of the present invention are achieved in the preferred embodiments disclosed below by providing a bed cover assembly for a mattress. The assembly includes a bottom sheet adapted for covering a top surface and sides of the mattress. A top sheet overlies the bottom sheet. Elastic attachment means are provided along a perimeter portion of the top sheet for elastically interconnecting the top sheet and the bottom sheet together. The attachment means cooperates with the top sheet and bottom sheet to form a resilient sleeping pocket around a bed occupant positioned therebetween. The attachment means accommodates movement of the top sheet relative to the bottom sheet upon movement of the bed occupant while maintaining the top sheet in an assembled condition over the bottom sheet and mattress.

According to one preferred embodiment of the invention, a top spread overlies the top sheet and includes releasable spread attachment means for releasably attaching and maintaining the spread in an assembled condition over the mattress.

Acccording to another preferred embodiment of the invention, the spread attachment means includes a spread attachment sheet for residing adjacent to an underside of the mattress. The sheet includes a plurality of attachment members located along a perimeter edge thereof for being releasably mated with complementary attachment members attached to the top spread.

According to yet another preferred embodiment of the invention, the spread attachment sheet includes first and second elastic side sections adapted for extending beyond respective sides of the mattress. The attachment members are connected to the elastic side sections and mate with the attachment members of the top spread such that the top spread is resiliently moveable relative to the mattress to accommodate movement of the bed occupant while maintaining the top spread in an assembled condition over the mattress.

According to yet another preferred embodiment of the invention, the spread attachment sheet further includes an elastic end section adapted for extending beyond a foot end of the mattress. The attachment members are connected to the elastic end section and mate with the attachment members of the top spread such that the top spread is resiliently moveable relative to the mattress to accommodate movement of the bed occupant while maintaining the top spread in an assembled condition over the mattress.

According to yet another preferred embodiment of the invention, the complementary attachment members of the top spread and attachment sheet include buttons and loops, respectively.

According to yet another preferred embodiment of the invention, the elastic attachment means includes first and second elastic side sections connected, respectively, to opposite sides of the top sheet and bottom sheet.

According to yet another preferred embodiment of the invention, the elastic attachment means further includes an elastic end section connected to a foot end of the top sheet and bottom sheet.

According to yet another preferred embodiment of the invention, an end of the first elastic side section opposite the elastic end section includes a releasable attachment member for releasably mating with a complementary attachment member located on the bottom sheet to allow ready ingress and egress into and from the sleeping pocket formed around the bed occupant.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
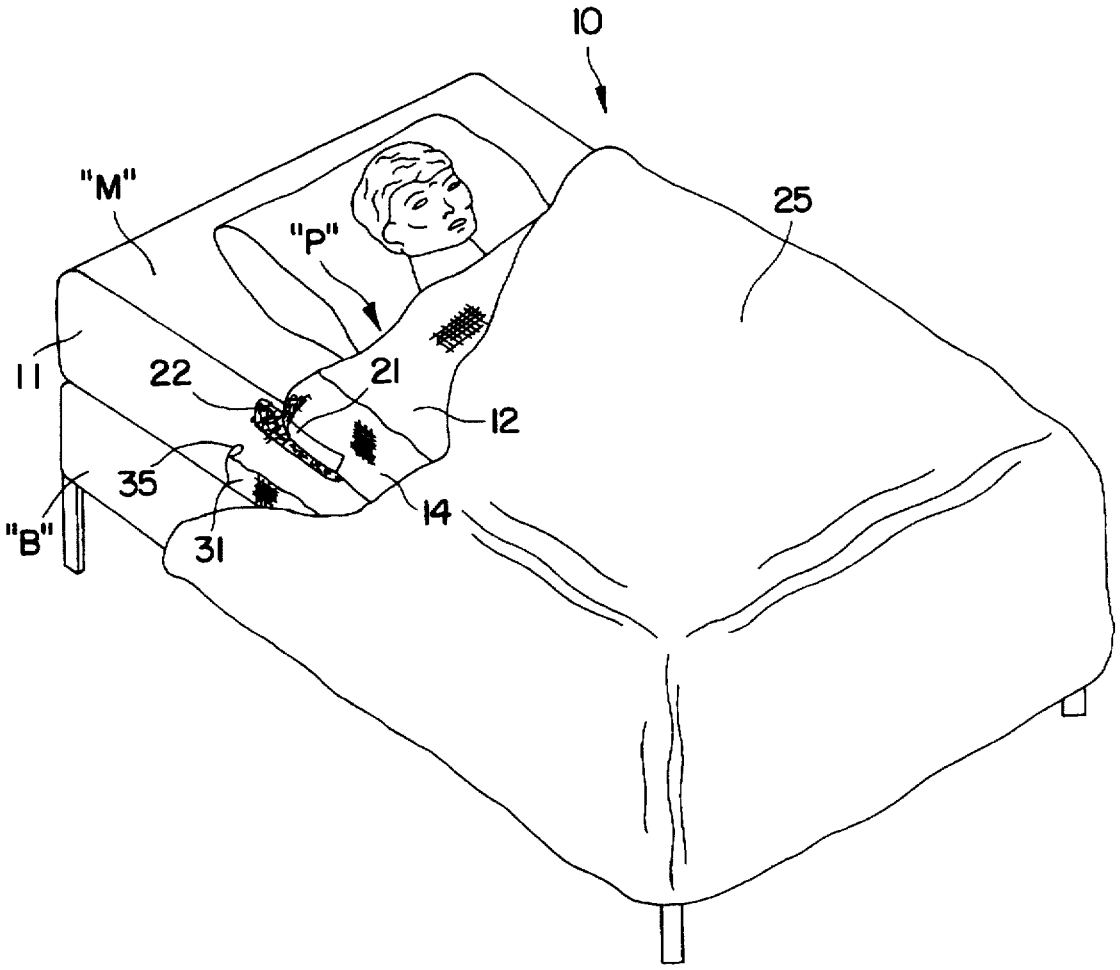
FIG. 1 is a perspective view of the bed cover assembly according to one preferred embodiment of the invention and showing a portion of the top spread torn away.

Referring now specifically to the drawings, a bed cover assembly according to the present invention is illustrated in FIG. 1 and shown generally at reference numeral 10. The bed cover assembly 10 is adapted for covering a standard size bed mattress "M", and remains in a substantially assembled condition over the mattress "M" during use by a bed occupant.

Figure 2:
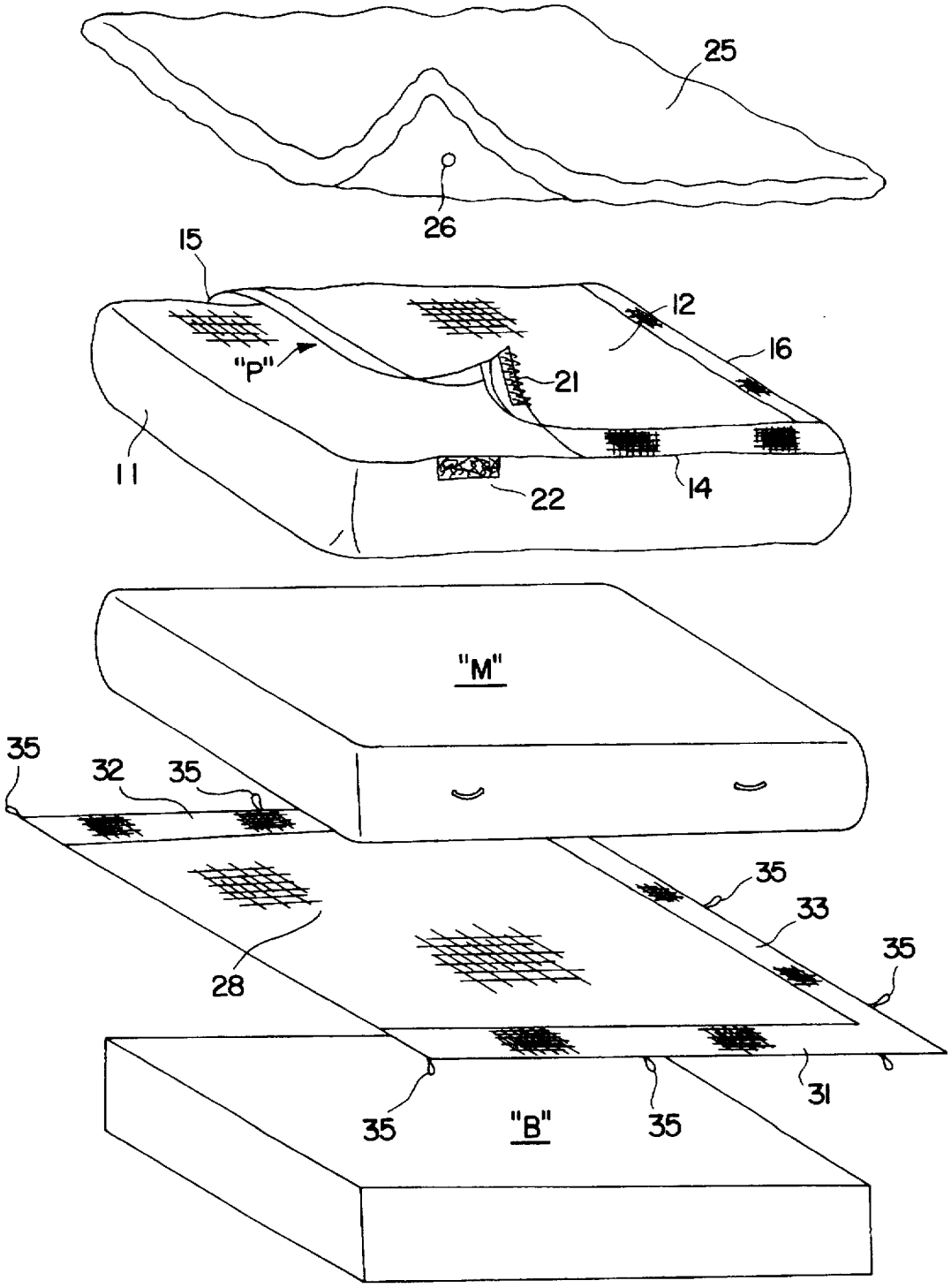
FIG. 2 is an exploded view of the bed cover assembly.
Figure 3:
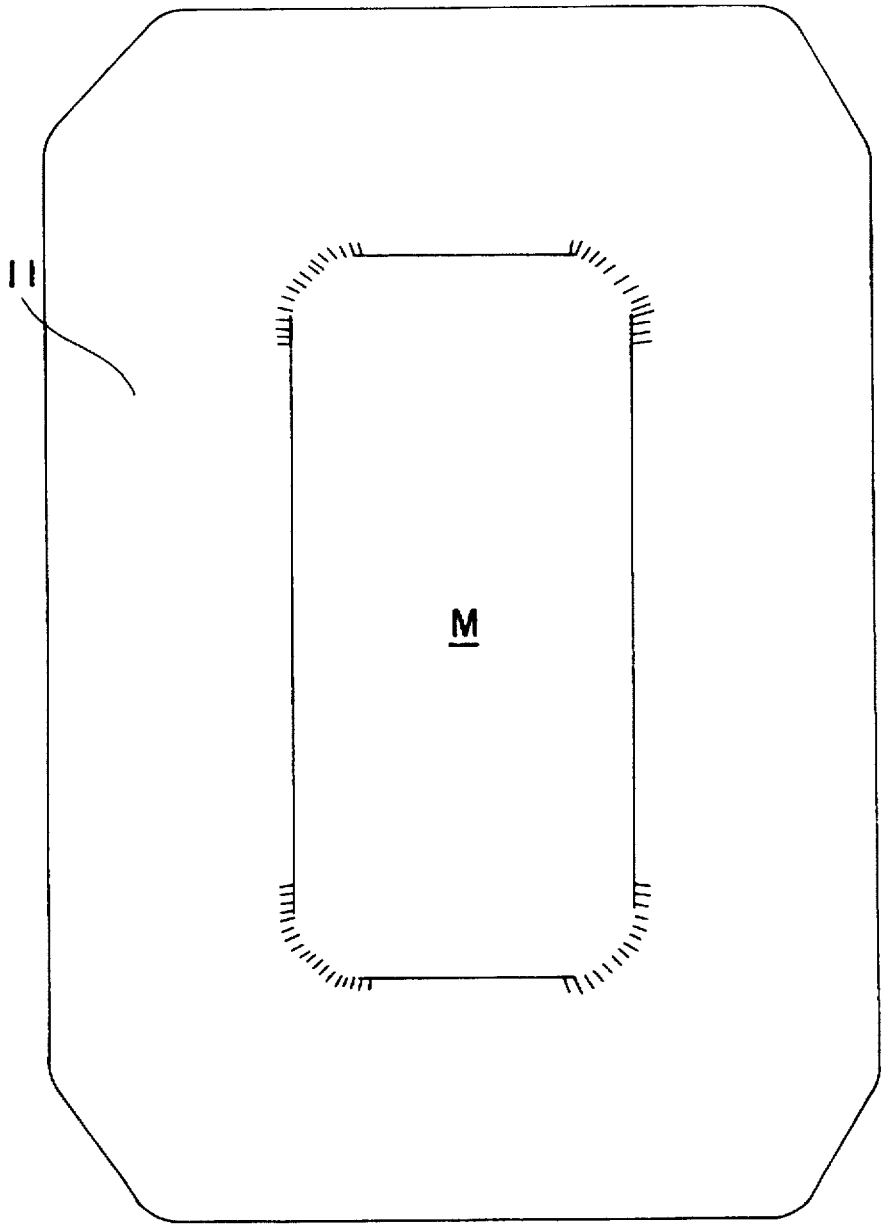
FIG. 3 is an underside view of the mattress with the fitted sheet attached.

As shown in FIGS. 1 and 2, the bed cover assembly 10 includes a bottom fitted sheet 11 with elastic corner portions for being positioned over respective corners of the mattress "M". The corner portions are preferably formed, as best shown in FIG. 3, such that a substantial portion of the fitted sheet 11 resides adjacent to the bottom side of the mattress "M" between the mattress "M" and the box springs "B" of the bed.

A top flat sheet 12 is secured along its side and end edges to the fitted sheet 11 by respective elastic side and end sections 14, 15, and 16. The side and end sections 14, 15, and 16 interconnect the fitted sheet 11 and flat sheet 12 together and cooperate with the sheets 11, 12 to form a resilient sleeping pocket "P" around the bed occupant lying between the sheets 11 and 12. The elastic sections 14, 15, and 16 allow sufficient lifting of the flat sheet 12 relative to the fitted sheet 11 to accommodate movement of the occupant while maintaining the flat sheet 12 in its assembled condition over the fitted sheet 11 during use. The elastic corner portions of the fitted sheet 11 provide a sufficiently secure hold to prevent the fitted sheet 11 from being inadvertently pulled away from the mattress "M".

According to one embodiment, the elastic side section 14 is sewn to the fitted sheet 11 along about one-half of the length of the flat sheet 12 and includes a strip 21 of attachment members, such as "Velcro", for being releasably mated with a complementary strip 22 of "Velcro" located on the fitted sheet 11. The releasable hook and loop attachment allows convenient opening and closing of the sleeping pocket "P" for ready ingress and egress of the bed occupant from between the sheets 11 and 12. In addition, a dust ruffle (not shown) may be removably attached along the perimeter sides and end of the fitted sheet 11 using patches of complementary "Velcro" attachment members.

As an alternative to the "Velcro" attachment described above, other attachment means may be used such as zippers, buttons, snaps, and the like.

Preferably, the bed cover assembly 10 further includes a detachable comforter 25 forming a top spread over the sheets 11, 12 and mattress "M". The comforter 25 includes a number of spaced-apart buttons 26 sewn to its inside surface near the perimeter side and end edges of the comforter 25. A spread attachment sheet 28 resides between the mattress "M" and box springs "B" of the bed and includes elastic side and end sections 31, 32, and 33 extending slightly beyond the sides and end of the mattress "M". The side and end sections 31, 32, and 33 of the sheet 28 include complementary button loops 35 for being releasably mated with the buttons 26 of the comforter 25, and for allowing sufficient lifting of the comforter 25 relative to the mattress "M" during use. According to the embodiment shown, the comforter 25 and sheet 28 include three complementary buttons 26 and loops 35 for each of the opposing sides and foot end of the mattress "M".

In the preferred application of the invention, the attached sheets 11, 12 and comforter 25 are used together to form an integrated bed cover assembly which remains in a substantially assembled condition over the mattress "M" during use. In an alternative application, the attached sheets 11 and 12 are used together with a standard, unattached top spread. In yet another application, the attachable comforter 25 and sheet 28 are used together with standard fitted and flat sheets.

A bed cover assembly is described above. Various details of the invention may be changed without departing from its scope. Furthermore, the foregoing description of the preferred embodiment of the invention and the best mode for practicing the invention are provided for the purpose of illustration only and not for the purpose of limitation--the invention being defined by the claims.

I claim:

1. A bed cover assembly for a mattress, comprising:

(a) a bottom sheet adapted for covering a top surface and sides of the mattress, said bottom sheet having opposed sides and a foot end, each of said opposed sides and said foot end having a length;

(b) a top sheet overlying the bottom sheet, said top sheet having opposed sides and a foot end, each of said opposed sides and said foot end having a length; and (c) an elastic attachment member located along a perimeter portion of the top sheet for elastically interconnecting the top sheet and the bottom sheet together, said elastic attachment member comprising first and second elastic side sections and an elastic end section, wherein each of said sections has an upper edge and a lower edge, the opposed sides of the top sheet being attached directly and respectively to the respective upper edges of said first and second elastic side sections along the respective lengths of each of said opposed sides of the top sheet, and the foot end of said top sheet being directly attached to said upper edge of said elastic end section along the length of said foot end of said top sheet, and the opposed sides of the bottom sheet being attached directly and respectively to the respective lower edges of said first and second elastic side sections along the respective lengths of each of said opposed sides of the bottom sheet, and the foot end of said bottom sheet being directly attached to said lower edge of said elastic end section along the length of said foot end of said bottom sheet; and (d) said elastic attachment member cooperating with the top sheet and bottom sheet to form a resilient sleeping pocket around a bed occupant positioned therebetween, such that said top sheet can be pulled in a direction away from said bottom sheet to accommodate movement of the bed occupant while maintaining the top sheet in an assembled condition over the bottom sheet and mattress.

2. A bed cover assembly according to claim 1, and including a top spread overlying the top sheet and including releasable spread attachment means for releasably attaching and maintaining the spread in an assembled condition over the mattress.

3. A bed cover assembly according to claim 2, wherein said spread attachment means comprises a spread attachment sheet for residing adjacent to an underside of the mattress, and including a plurality of attachment members located along a perimeter edge thereof for being releasably mated with complementary attachment members attached to said top spread.

4. A bed cover assembly according to claim 3, wherein said spread attachment sheet includes first and second elastic side sections adapted for extending beyond respective sides of the mattress, and wherein said attachment members are connected to the elastic side sections and mate with the attachment members of the top spread such that the top spread is resiliently moveable relative to the mattress to accommodate movement of the bed occupant while maintaining the top spread in an assembled condition over the mattress.

5. A bed cover assembly according to claim 4, wherein said spread attachment sheet further includes an elastic end section adapted for extending beyond a foot end of the mattress, and wherein said attachment members are connected to the elastic end section and mate with the attachment members of the top spread such that the top spread is resiliently moveable relative to the mattress to accommodate movement of the bed occupant while maintaining the top spread in an assembled condition over the mattress.

6. A bed cover assembly according to claim 3, wherein said complementary attachment members of the top spread and attachment sheet comprise buttons and loops, respectively.

7. A bed cover assembly according to claim 1, wherein an end of the first elastic side section opposite the elastic end section includes a releasable attachment member for releasably mating with a complementary attachment member located on said bottom sheet to allow ready ingress and egress into and from the sleeping pocket formed around the bed occupant.

8. In combination with a bed mattress, a bed cover assembly for covering the mattress, comprising:

(a) a fitted sheet adapted for covering a top surface and sides of the mattress, said fitted sheet having opposed sides and a foot end, each of said opposed sides and said foot end having a length;

(b) a flat sheet overlying the fitted sheet, said flat sheet having opposed sides and a foot end, each of said opposed sides and said foot end having a length; and (c) an elastic attachment member located along a perimeter portion of the flat sheet for elastically interconnecting the flat sheet and the fitted sheet together, said elastic attachment member comprising first and second elastic side sections and an elastic end section, wherein each of said sections has an upper edge and a lower edge, the opposed sides of the flat sheet being attached directly and respectively to the respective upper edges of said first and second elastic side sections along the respective lengths of each of said opposed sides of the flat sheet, and the foot end of said flat sheet being directly attached to said upper edge of said elastic end section along the length of said foot end of said flat sheet, and the opposed sides of the fitted sheet being attached directly and respectively to the respective lower edges of said first and second elastic side sections along the respective lengths of each of said opposed sides of the fitted sheet, and the foot end of said fitted sheet being directly attached to said lower edge of said elastic end section along the length of said foot end of said fitted sheet; and (d) said elastic attachment member cooperating with the flat sheet and fitted sheet to form a resilient sleeping pocket around a bed occupant positioned therebetween, such that said flat sheet can be pulled in a direction away from said fitted sheet to accommodate movement of the bed occupant while maintaining the flat sheet in an assembled condition over the fitted sheet and mattress.

9. A combination according to claim 8, and including a top spread overlying the flat sheet and including releasable spread attachment means for releasably attaching and maintaining the spread in an assembled condition over the mattress.

10. A combination according to claim 9, wherein said spread attachment means comprises a spread attachment sheet residing adjacent to an underside of the mattress, and including a plurality of attachment members located along a perimeter edge thereof for being releasably mated with complementary attachment members attached to said top spread.

11. A combination according to claim 10, wherein said spread attachment sheet includes first and second elastic side sections extending beyond respective sides of the mattress, and wherein said attachment members are connected to the elastic side sections and mate with the attachment members of the top spread such that the top spread is resiliently moveable relative to the mattress to accommodate movement of the bed occupant while maintaining the top spread in an assembled condition over the mattress.

12. A combination according to claim 11, wherein said spread attachment sheet further includes an elastic end section extending beyond a foot end of the mattress, and wherein said attachment members are connected to the elastic end section and mate with the attachment members of the top spread such that the top spread is resiliently moveable relative to the mattress to accommodate movement of the bed occupant while maintaining the top spread in an assembled condition over the mattress.

13. A combination according to claim 10, wherein said complementary attachment members of the top spread and attachment sheet comprise buttons and loops, respectively.

14. A combination according to claim 8, wherein an end of the first elastic side section opposite the elastic end section includes a releasable attachment member for releasably mating with a complementary attachment member located on said fitted sheet to allow ready ingress and egress into and from the sleeping pocket formed around the bed occupant.

* * * * *